US010823011B2

(12) United States Patent
Kantany et al.

(10) Patent No.: US 10,823,011 B2
(45) Date of Patent: Nov. 3, 2020

(54) TURBINE ENGINE TIE ROD SYSTEMS

(71) Applicant: United Technologies Corporation, Farmington, CT (US)

(72) Inventors: Nicholas W. Kantany, Manchester, CT (US); David T. Feindel, Ellington, CT (US); Nico M. Rappoli, Middletown, CT (US)

(73) Assignee: Raytheon Technologies Corporation, Farmington, CT (US)

( * ) Notice: Subject to any disclaimer, the term of this patent is extended or adjusted under 35 U.S.C. 154(b) by 70 days.

(21) Appl. No.: 16/270,102

(22) Filed: Feb. 7, 2019

(65) Prior Publication Data

US 2020/0256216 A1 Aug. 13, 2020

(51) Int. Cl.
*F01D 25/24* (2006.01)
*F01D 25/26* (2006.01)

(52) U.S. Cl.
CPC ..... *F01D 25/26* (2013.01); *F05D 2220/32* (2013.01)

(58) Field of Classification Search
CPC ..... F01D 25/24; F01D 25/26; F05D 2260/31; F02C 7/20
See application file for complete search history.

(56) References Cited

U.S. PATENT DOCUMENTS 4,979,872 A 12/1990 Myers et al.
5,076,049 A * 12/1991 Von Benken ..... F01D 25/24 60/797
5,160,251 A * 11/1992 Ciokajlo ..... F01D 25/162 415/142
5,326,222 A 7/1994 Matyscak et al.
5,385,015 A * 1/1995 Clements ..... F23R 3/20 60/39.826
9,784,129 B2 10/2017 Eleftheriou et al.
9,951,721 B2 4/2018 Kupratis et al.
10,036,281 B2 7/2018 McCaffrey
2015/0345337 A1 12/2015 Petty et al.

FOREIGN PATENT DOCUMENTS

DE 102011077502 A1 12/2012
EP 1655457 A1 5/2006
GB 2490781 A 11/2012

OTHER PUBLICATIONS

European Search Report dated May 12, 2020 for European Patent Application No. 19213970.7.

* cited by examiner

*Primary Examiner* — Ninh H. Nguyen
(74) *Attorney, Agent, or Firm* — Bachman & LaPointe, P.C.

(57) ABSTRACT

A gas turbine engine turbine section has tie rod assemblies interconnecting an inner diameter structure and an outer casing. Each tie rod has: an inner diameter end; an outer diameter end; and an eyelet of an outer diameter spherical bearing formed at the outer diameter end. A first clevis carries a spherical ball of the bearing, a shank of said clevis extending to an outer diameter (OD) end. A tensioning bolt is mated to a threaded opening in said clevis OD end whereby tightening said bolt applies a tension to said rod. A radial span between a center of the outer diameter spherical bearing and an inner diameter surface of the outer casing is at least 50% greater than that between an outer diameter (OD) surface of the outer ring and the center.

20 Claims, 5 Drawing Sheets

TURBINE ENGINE TIE ROD SYSTEMS

U.S. GOVERNMENT RIGHTS

This invention was made with Government support awarded by the United States. The Government has certain rights in this invention.

BACKGROUND

The disclosure relates to gas turbine engines. More particularly, the disclosure relates to turbine section tie rods radially connecting inner diameter structure to outer diameter structure across one or more paths.

U.S. Pat. No. 4,979,872 (the '872 patent), of Myers et al., Dec. 25, 1990, and entitled "Bearing compartment support", discloses tensioned tie rods connecting an inner diameter bearing compartment to an outer diameter structural case, spanning across a gaspath. The disclosure of the '872 patent is incorporated by reference in its entirety herein as if set forth at length. The illustrated configuration has a circumferential array of hollow struts spanning the core flowpath between an inner ring and an outer ring. Outboard of the outer ring is a flowpath carrying bypass air from a fan or compressor for various cooling purposes. The tie rods pass radially through the hollow struts. Outer diameter (OD) ends of the tie rods form the eyelet portion of a spherical bearing system capturing the sphere (bearing) surface. The sphere is carried by a clevis extending radially outward. The outer diameter (OD) end of the clevis receives a tensioning bolt passing through the structural case.

SUMMARY

One aspect of the disclosure involves a gas turbine engine turbine section comprising: an inner diameter structure; a turbine exhaust case surrounding the inner diameter structure and having an outer ring and an inner ring in concentric and radially spaced relationship and a plurality of circumferentially spaced hollow struts interconnecting and supporting said inner ring and said outer ring to each other; an outer casing surrounding said outer ring; and a plurality of tie rod assemblies interconnecting said inner diameter structure and said outer casing. Each of said tie rod assemblies comprises: a tie rod; at least a first clevis; and a tensioning bolt. The tie rod has: an inner diameter end; an outer diameter end; and an eyelet of an outer diameter spherical bearing formed at the outer diameter end. The first clevis carries a spherical ball between arms of said clevis, said spherical ball captured by the outer diameter spherical bearing eyelet, a shank of said clevis extending to an outer diameter (OD) end of said clevis. The tensioning bolt is mated to a threaded opening formed in said clevis OD end whereby tightening said bolt applies a tension to said rod relative to the outer casing. A radial span between a center of the outer diameter spherical bearing and an inner diameter surface of the outer casing is at least 50% greater than a radial span between an outer diameter (OD) surface of the outer ring and the center of the spherical bearing.

A further embodiment of any of the foregoing embodiments may additionally and/or alternatively include the tie rod assemblies further comprising: a plurality of struts, each strut respectively associated with an associated one of the tie rods. The strut extends radially between the clevis OD end and the outer casing to transmit the tension from the associated rod to the outer casing.

A further embodiment of any of the foregoing embodiments may additionally and/or alternatively include each strut having a hollow body extending between an outer diameter end an inner diameter end. The inner diameter end has a web. The associated tensioning bolt extends through the web.

A further embodiment of any of the foregoing embodiments may additionally and/or alternatively include each strut outer diameter end having one or more laterally outwardly protruding mounting projections; and one or more fasteners secure the one or more mounting projections to the outer casing.

A further embodiment of any of the foregoing embodiments may additionally and/or alternatively include each strut being formed of a wrought nickel-based alloy.

A further embodiment of any of the foregoing embodiments may additionally and/or alternatively include a radial span between a center of the outer diameter spherical bearing and the clevis OD end being at least 50% greater than a radial span between an outer diameter (OD) surface of the outer ring and the center of the spherical bearing.

A further embodiment of any of the foregoing embodiments may additionally and/or alternatively include said radial span between the center of the spherical bearing and the clevis OD end being at least 100% greater than the radial span between the outer diameter (OD) surface of the outer ring and the center of the spherical bearing.

A further embodiment of any of the foregoing embodiments may additionally and/or alternatively include the clevis shank comprising a plurality of transverse apertures.

A further embodiment of any of the foregoing embodiments may additionally and/or alternatively include a spring rate of each tie rod assembly between the tie rod and the outer casing being greater than a spring rate of the associated tie rod.

A further embodiment of any of the foregoing embodiments may additionally and/or alternatively include for each tie rod assembly: the tie rod having an inner diameter spherical bearing eyelet formed at the inner diameter end; and a second clevis being mounted to the inner diameter structure and carries a second spherical ball between arms of said second clevis, said second spherical ball captured by the inner diameter spherical bearing eyelet.

A further embodiment of any of the foregoing embodiments may additionally and/or alternatively include for each tie rod assembly: a radial span between a center of the outer diameter spherical bearing and an inner diameter surface of the outer casing being 30% to 200% of a radial span between the center of the inner diameter spherical bearing and the center of the outer diameter spherical bearing.

Another aspect of the disclosure involves a gas turbine engine turbine section comprising: an inner diameter structure; a turbine exhaust case surrounding the inner diameter structure and having an outer ring and an inner ring in concentric and radially spaced relationship and a plurality of circumferentially spaced hollow struts interconnecting and supporting said inner ring and said outer ring to each other; an outer casing surrounding said outer ring; and a plurality of tie rod assemblies interconnecting said inner diameter structure and said outer casing. Each of said tie rod assemblies comprising: a tie rod having: an inner diameter end; an outer diameter end; an eyelet of an inner diameter spherical bearing formed at the inner diameter end; and an eyelet of an outer diameter spherical bearing formed at the outer diameter end; an inner diameter clevis mounted to the inner diameter structure and carrying a first spherical ball between arms of said second clevis, said first spherical ball captured by the inner diameter spherical bearing eyelet; and an outer diameter clevis carrying a second spherical ball between arms of said outer diameter clevis, said second spherical ball captured by the outer diameter spherical bearing eyelet, a shank of said clevis extending to an outer diameter (OD) of said clevis; and a tensioning bolt mated to a threaded opening formed in said clevis OD end whereby tightening said bolt applies a tension to said rod relative to the outer casing. For each tie rod assembly: a radial span between a center of the outer diameter spherical bearing and an inner diameter surface of the outer casing is 30% to 200% of a radial span between the center of the inner diameter spherical bearing and the center of the outer diameter spherical bearing.

A further embodiment of any of the foregoing embodiments may additionally and/or alternatively include for each tie rod assembly: the radial span between the center of the outer diameter spherical bearing and the inner diameter surface of the outer casing being 40% to 100% of the radial span between the center of the inner diameter spherical bearing and the center of the outer diameter spherical bearing.

A further embodiment of any of the foregoing embodiments may additionally and/or alternatively include the tie rod assemblies each further comprising: a strut associated with the tie rod, wherein: the strut extends radially between the clevis OD end and the outer casing to transmit the tension from the associated rod to the outer casing.

A further embodiment of any of the foregoing embodiments may additionally and/or alternatively include: each strut having a hollow body extending between an outer diameter end and an inner diameter end; the inner diameter end having a web; and the associated tensioning bolt extends through the web.

A further embodiment of any of the foregoing embodiments may additionally and/or alternatively include: each strut outer diameter end having one or more laterally outwardly protruding mounting projections; and one or more fasteners securing the one or more mounting projections to the outer casing.

A further embodiment of any of the foregoing embodiments may additionally and/or alternatively include each strut being formed of a wrought nickel-based alloy.

Another aspect of the disclosure involves a gas turbine engine turbine section comprising: an inner diameter structure; a turbine exhaust case surrounding the inner diameter structure and having an outer ring and an inner ring in concentric and radially spaced relationship and a plurality of circumferentially spaced hollow struts interconnecting and supporting said inner ring and said outer ring to each other; an outer casing surrounding said outer ring; a plurality of tie rod assemblies interconnecting said inner diameter structure and said outer casing. Each of said tie rod assemblies comprises: a tie rod having: an inner diameter end; an outer diameter end; and a spherical bearing eyelet formed at the outer diameter end; at least a first clevis carrying a spherical ball between arms of said clevis, said spherical ball captured by the spherical bearing eyelet, said first clevis comprising: a first shank having an outer diameter (OD) end; and a second shank having an outer diameter (OD) end; and a first bolt extending through an opening formed in said outer casing and mated to a threaded opening formed in said first shank OD end and a second bolt extending through an opening formed in said and mated to a threaded opening formed in said second shank OD end whereby tightening said first and second bolts applies a tension to said rod.

A further embodiment of any of the foregoing embodiments may additionally and/or alternatively include each first clevis being formed of a wrought nickel-based alloy.

A further embodiment of any of the foregoing embodiments may additionally and/or alternatively include the first and second shanks being at the same axial position along the engine.

The details of one or more embodiments are set forth in the accompanying drawings and the description below. Other features, objects, and advantages will be apparent from the description and drawings, and from the claims.

BRIEF DESCRIPTION OF THE DRAWINGS

Like reference numbers and designations in the various drawings indicate like elements.

DETAILED DESCRIPTION

Engine developments are placing increasing demands on tie rods. U.S. Pat. No. 9,951,721 (the '721 patent), of Kupratis et al., Apr. 24, 2018, and entitled "Three-stream gas turbine engine architecture" discloses the addition of two concentric streams/flowpaths beyond the core stream/flowpath and radially outwardly shifting the outermost case structures. The disclosure of the '721 patent is incorporated by reference in its entirety herein as if set forth at length. Connecting a tie rod from a bearing compartment in a core to either the outermost case structure at the OD of the outermost stream or to case structure between the two outer streams would significantly lengthen the tie rod.

Figure 1:
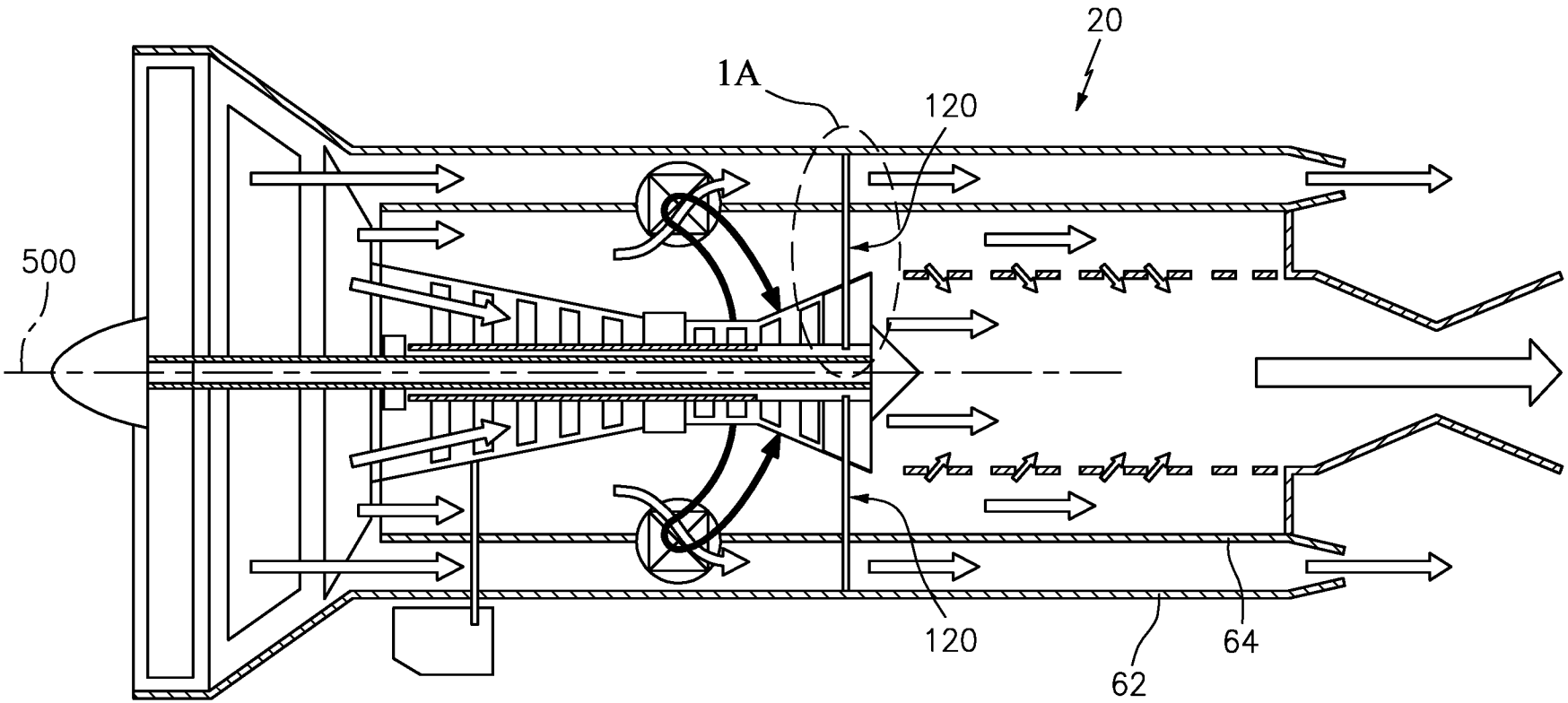
FIG. 1 is a schematic central longitudinal sectional view of a gas turbine engine.
Figure 1A:
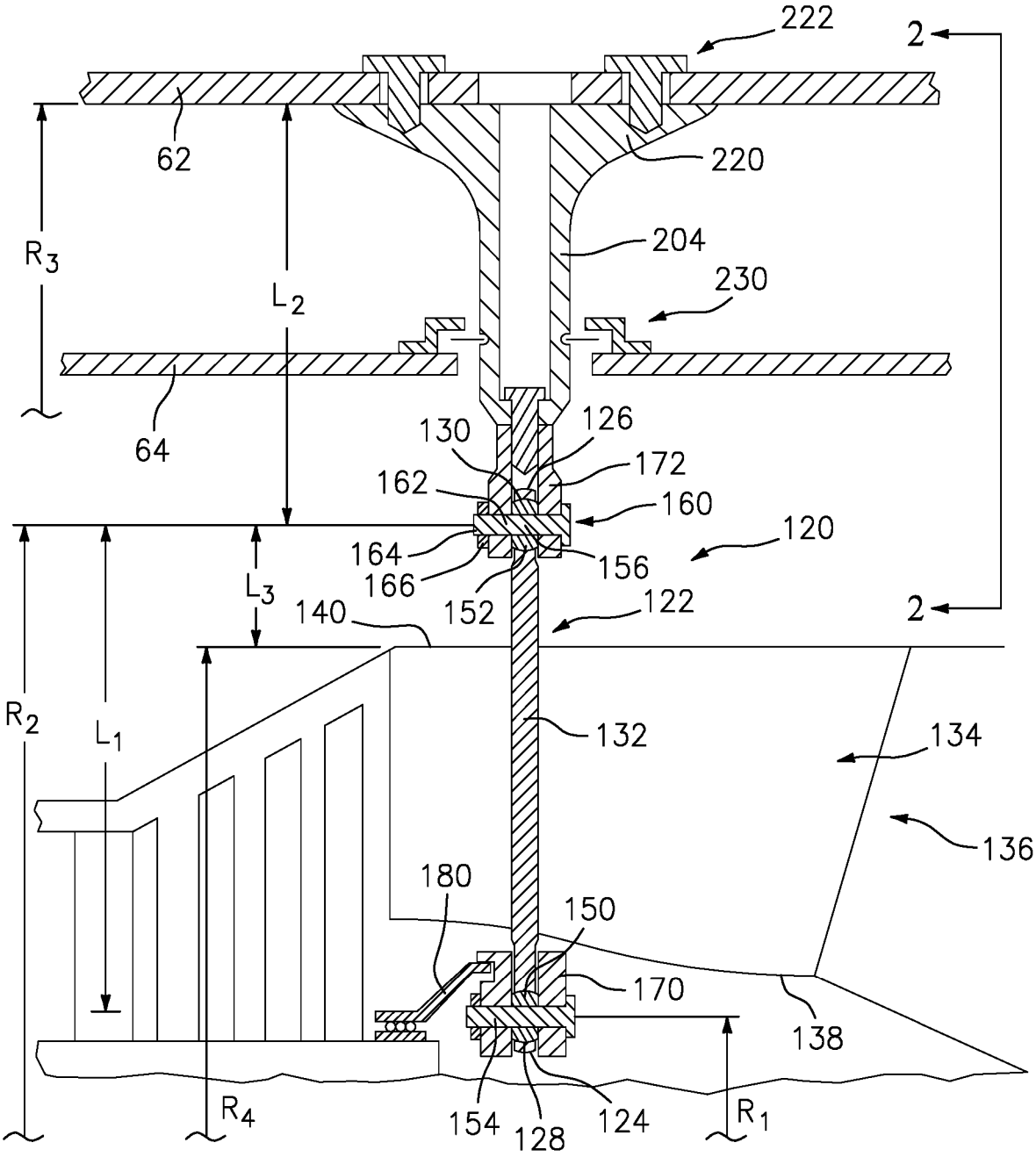
FIG. 1A is an enlarged view of a turbine exhaust case area of the engine showing a tie rod assembly.

FIG. 1 shows a gas turbine engine 20 (having a centerline 500) based on the configuration of the '721 patent. FIG. 1A shows the addition of a first tie rod assembly 120 based upon the tie rod assembly of the '872 patent.

The assembly 120 includes a rod 122 having an inner diameter end 124 and an outer diameter end 126. At the inner diameter end, an eyelet 128 is formed and, at the outer diameter end 126, an eyelet 130 is formed. The rod 122 has a main body or shank portion 132 passing through an associated hollow strut 134 of the turbine exhaust case 136. The strut extends between an inner diameter (ID) ring 138 and an outer diameter (OD) ring 140 (also FIGS. 3 and 5).

Figure 2:
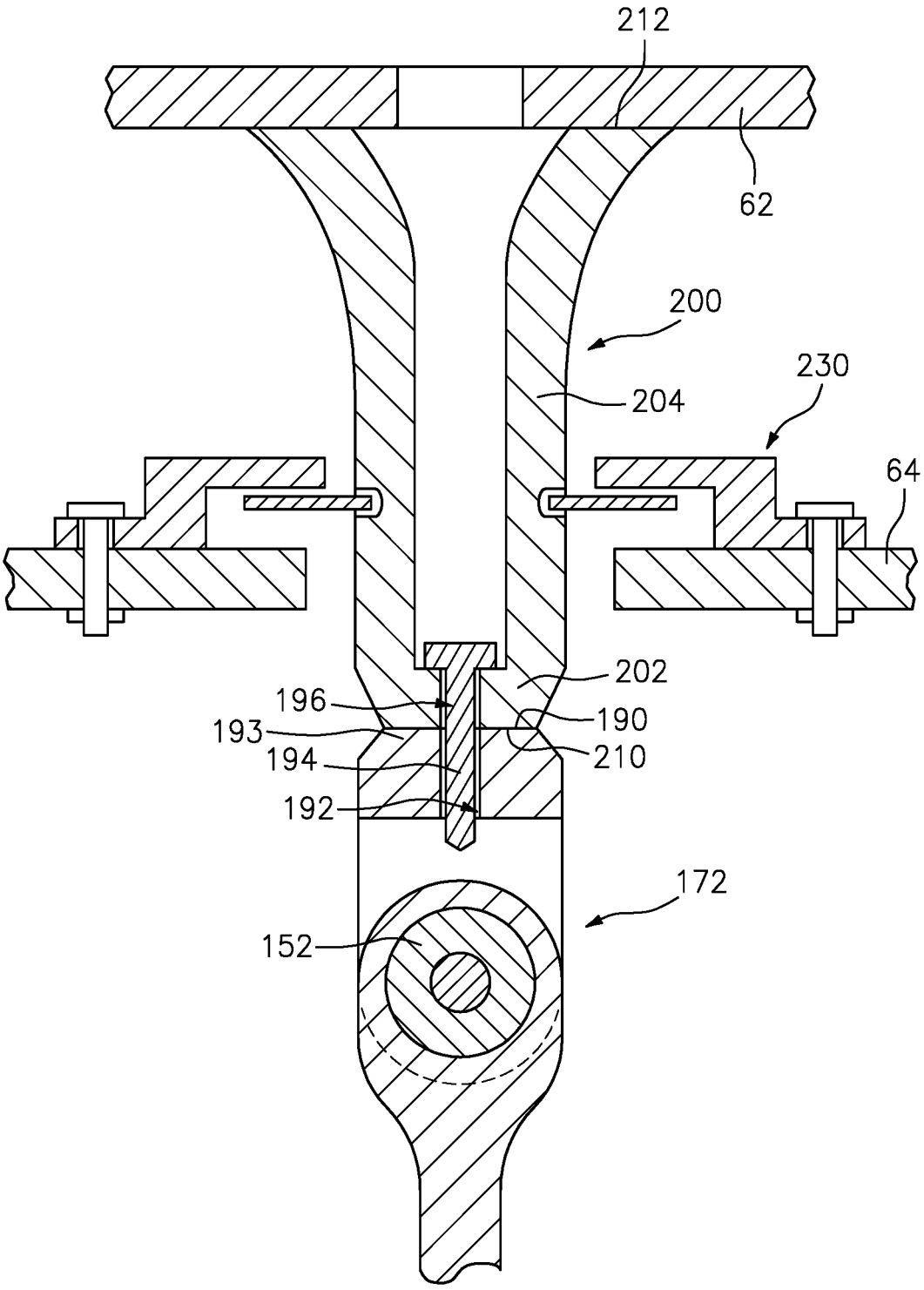
FIG. 2 is a partial, partially schematic, transverse sectional view of the engine showing an outer diameter portion of the tie rod assembly.

The ID eyelet 128 and OD eyelet 130 respectively capture spheres or bearings 150 (FIG. 1), 152 (also FIG. 2). The spheres are supported by shafts 154, 156. Exemplary shafts are separately formed from the bearings and pass through apertures in the bearings. Exemplary shafts are formed as bolts having heads 160, shanks 162, and distal threaded end portions 164 receiving nuts 166. The bolt shanks pass through arms of the respective ID and OD clevis 170, 172. The ID clevis 170 is mounted relative to engine static structure (e.g., snap engaged to a rear bearing hub 180).

The exemplary OD clevis 172 extends to an OD end 190 (FIG. 2). A threaded bore 192 extending inward from the OD end 190 in a shank 193 of the clevis receives the shank 194 of a tensioning bolt 196. The tensioning bolt is carried by a strut 200 extending radially inward from the outer case 62. The exemplary strut 200 is hollow with a centrally-apertured lower web 202 having an aperture passing the tensioning bolt shank 194. An OD surface of the web 202 surrounding the aperture (hole) compressively engages the underside of the tensioning bolt head to allow tension to be transmitted through the bolt.

The strut 200 extends from an ID end 210 contacting or in close-facing spaced-apart relation to the clevis OD end 190 to an OD end 212 mounted to the outer case 62. An exemplary mounting is via a pair of mounting ears 220 (FIG. 1A) having threaded apertures receiving the shafts of mounting bolts 222 passing through the outer case 62. A hollow shank 204 of the strut 200 passes through an aperture in the inner case 64 and may be sealed to it via a seal structure 230 (e.g., a blade-type slider seal).

FIG. 1A shows the OD bearing at a radial position $R_2$ and the ID bearing at a radial position $R_1$. The effective length $L_1$ of the tie rod is $R_2$-$R_1$. The outer duct inner diameter (ID) surface is shown at a radius $R_3$. The outer ring 140 outer diameter (OD) surface is shown at radius $R_4$.

Use of the strut 200 allows $R_2$ (and thus $L_1$) to be limited.

A longer tie rod (e.g., where the OD bearing was near the outer case) potentially involves problems as the engine encounters dynamic loads. For example, a lengthened tie rod may be more subject to buckling. Geometric constraints may preclude making the tie rod more rigid and resistant to buckling. This is particularly relevant where an existing engine core configuration is applied to an application with larger radial span. By tailoring the relative length of the tie rod 122 and strut 200, as well as their relative tensile properties (e.g., spring constant (via geometry and material elastic modulus)) one can apportion the relative pre-tensioning strains on the strut 200 and the tie rod. This can avoid failures under dynamic loads. For example, as discussed below, compressive buckling may be avoided.

The ability to tailor the tie rod to the strut (or strut/clevis system) will depend on the available length or radial span of the strut/clevis system. This length is shown as $L_2$ in FIG. 1A. Some portion of this length will be unusable due to mounting considerations. For example, in the FIG. 1A embodiment, the OD clevis 172 and the OD mounting portion (adjacent ears 220) of the strut will be relatively rigid leaving the strut hollow shank 204 to be optimized to provide desired compliance. To provide sufficient radial span for optimizing the strut/OD clevis system, exemplary $L_2$ is at least 30% of $L_1$, more particularly, 30% to 200% or 40% to 100%.

An alternative measurement reflects the tie rod protruding from the OD ring 140. In such a case, the radial span $L_2$ between the center of the OD spherical bearing and the clevis shank OD end may be at least 50% greater than a radial span $L_3$ (or $R_2$-$R_4$) between an outer diameter (OD) surface of the outer ring 140 and the center of the OD spherical bearing. More particularly, exemplary $L_2$ may be 150% to 1000% of $L_3$ or 200% to 1000% or 300% to 800%.

Whereas the FIG. 1A first assembly 120 uses a relatively conventionally-dimensioned OD clevis 172 but adds a strut 200, other variations are possible.

Figure 3:
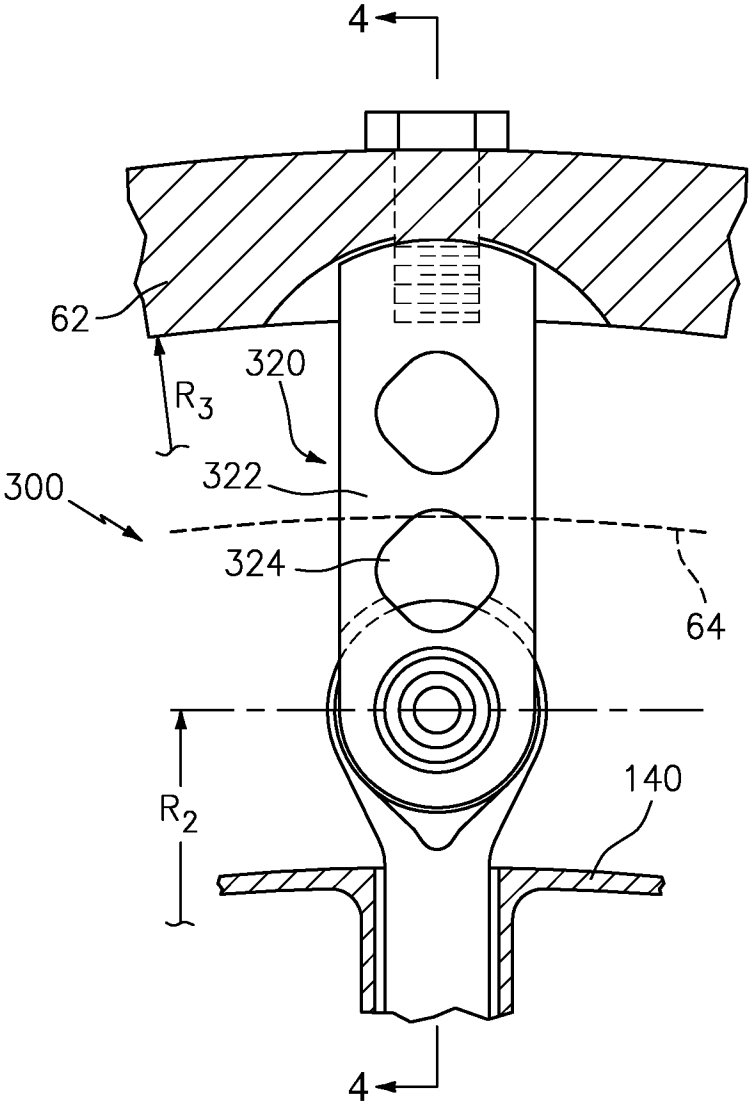
FIG. 3 is a transverse sectional view showing an alternate second tie rod assembly.
Figure 4:
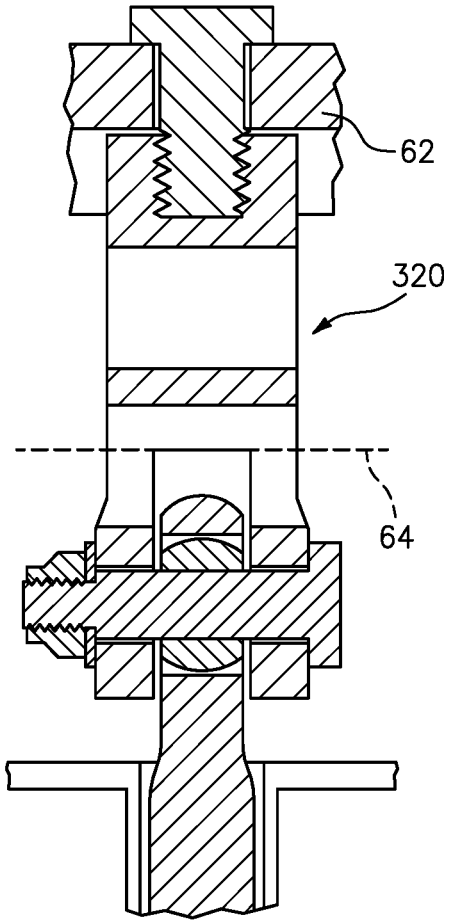
FIG. 4 is a longitudinal sectional view of the second tie rod assembly along line 4-4 of FIG. 3.

FIGS. 3 and 4 show tie rod assembly 300 wherein, effectively, the OD clevis 320 is lengthened so as to engage the outer case 62 in a more conventional manner such as that of the '872 patent. The exemplary clevis shank 322 is shown with transverse apertures 324 reducing the spring constant to a desired tailored level.

Although no separate strut is involved, the increased clevis length can allow optimization of the clevis compliance in a portion of the clevis between the clevis arms and the threaded bore. For this embodiment, the analogous length to $L_2$ alternatively be measured from the clevis's bearing center to its OD end or via the $R_3$-$R_2$ number used for the first embodiment. This length may have a similar relationship to the tie rod length as that of the first embodiment.

Figure 5:
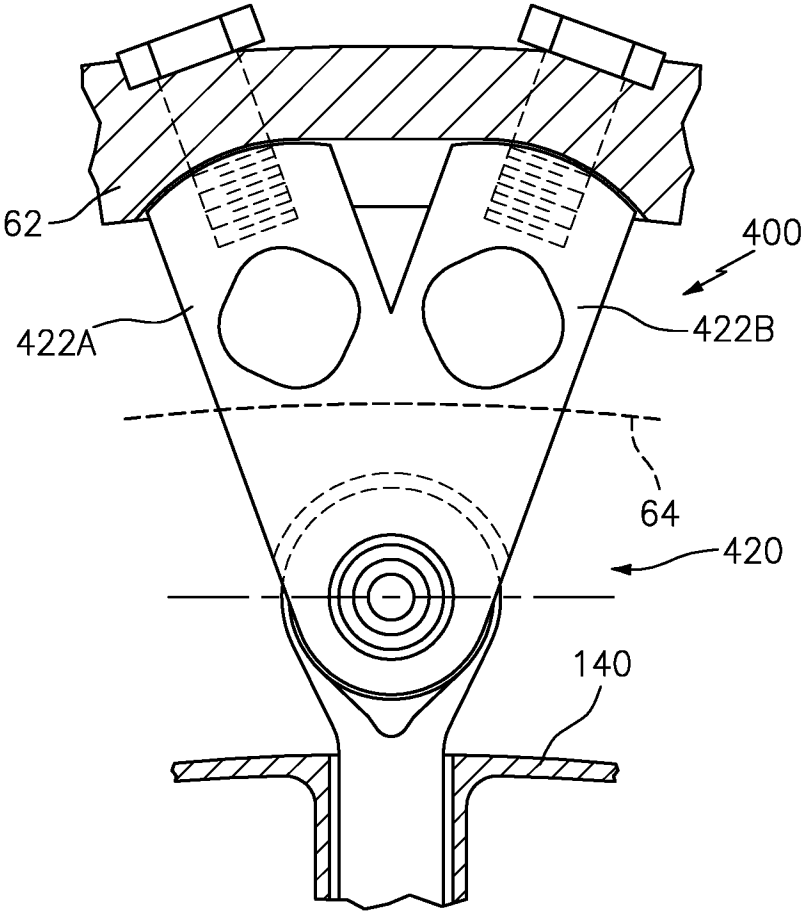
FIG. 5 is a transverse sectional view showing an alternate third tie rod assembly.

FIG. 5 shows an alternative third tie rod assembly 400 otherwise similar to the second tie rod assembly 300 but wherein the OD clevis 420 has two shanks 422A, 422B which diverge from each other radially outwardly. Each shank has an associated tensioning bolt so that the two tensioning bolts are spaced circumferentially apart on the outer case. The use of two shanks provides further variation in the ability to tailor the spring response of the system.

Tables I and II below illustrate an example where a baseline rod length $L_1$ is ten inches. A hypothetical revised rod length is fifteen inches. For example, the revised situation may involve any of: a) modifying the baseline engine to outwardly shift a given case structure; b) modifying the baseline engine to add a different case structure outboard and shift from anchoring the OD end of the rod to said different case structure (e.g., shifting from 64 to 62 when 62 is added to an engine already having 64); or c) shifting from anchoring OD end of the rod from one case structure of the baseline to a different case structure that is already in the baseline (e.g., shifting from 64 to 62 in an engine already having both).

From Table I, if all other factors are held constant, the length increase from ten to fifteen inches reduces the threshold buckling compressive load from the baseline of over 550 lbs. to about 250 lbs. The latter is below the target compressive load and thus the rod will likely buckle in service. Although compressive performance could be increased by increasing rod diameter, packaging or other constraints may preclude this.

From Table II, it is seen how use of the strut may recapture compressive performance of the tie rod. Although the example preserves Tie rod length, other examples could change tie rod length such as by increasing it by only a portion of the added overall radial span change between mounting points from the baseline to the revised configuration. To accommodate a given deflection, the strut reduces the required loads on the tie rod system. Thus, whereas a lengthened rod would still need to handle the 1500 lb. tensile and 300 lb. compressive load, the strut allows these to be reduced to about 1300 lbs. and 260 lbs., respectively. In the particular example, the 260 lb. value is well within the buckling capability of the rod. In other cases, where this is not the case either a small amount of margin must be given up or a small further strengthening of the rod made if constraints allow.

TABLE I

| Desc. | Sym | Value | Value | Units | Formula | Comment |
|---|---|---|---|---|---|---|
| Length of the rod | L or $L_1$ | 10 | 15 | In. | — | |
| Target tensile force through rod | $P_T$ | 1500 | 1500 | Lbs. | — | |
| Target compression force through rod | $P_C$ | 300 | 300 | Lbs. | — | |
| Modulus of elasticity | E | 30.0 | 30.0 | Mpsi | — | Exemplary material |
| Yield capability of material | $S_y$ | 40,000 | 40,000 | psi | — | Exemplary material |
| Max rod diameter | d | 0.25 | 0.25 | in. | — | |
| Rod cross-sectional area | A | 0.049 | 0.049 | $in.^2$ | $\frac{1}{4}\pi d^2$ | |
| Area moment of inertia | I | 0.0002 | 0.0002 | $in.^4$ | $\frac{\pi d\text{^}4}{64}$ | |
| Buckling capability of the rod | $P_{cr}$ | 567.7 | 252.33 | Lbs. | $\frac{\pi^2 EI}{(cL)^2}$ | Assumes pin rod ends required for thermal compliance c = 1 |
| Tensile Stress in rod | σ | 30557.74 | 30557.74 | psi | P/A | |

TABLE II

| Desc. | Symbol | Formula | Units | Long Rod Value | Short Rod + Strut Value | Comment |
|---|---|---|---|---|---|---|
| Rod Length | L or $L_1$ | — | in. | 15 | 10 | |
| Rod Cross Sectional Area | A | — | $in.^2$ | | 0.049 | |
| Modulus of Elasticity | E | — | Mpsi | | 30.0 | |
| Rod Stiffness | $K_{Rod}$ | $\frac{AL}{E}$ | Lbs./in. | 98,174 | 147,262 | Shorter rod is stiffer |
| Strut Stiffness | $K_{Strut}$ | — | Lbs./in. | N/A | 160,000 | |
| Rest of System Stiffness | $K_{Other}$ | — | Lbs./in. | 90,000 | 90,000 | |
| Total System Stiffness | $K_{System}$ | $\frac{1}{k_1}+\frac{1}{k_2}+\ldots$ | Lbs./in. | 46,954 | 38,116.94 | |
| Tensile Load | P | $k_{system}x$ | Lbs. | 1500 | 1322.7 | Given for Long Rod, calculated for Short Rod + Strut |
| Tensile Deflection | x | $P/k_{System}$ | in. | 0.032 | 0.032 | Calculated for Long Rod, Given for Short Rod + Strut |
| Compressive Load | P | $k_{system}x$ | Lbs. | 300 | 264.5 | Given for Long Rod, calculated for Short Rod + Strut |
| Compressive Deflection | x | $P/k_{System}$ | in. | 0.006 | 0.006 | Calculated for Long Rod, Given for Short Rod +Strut |

Conventional manufacturing materials and methods may be used for the tie rod and clevis. Typical tie rod and clevis materials are nickel-based superalloy (e.g., wrought and machined). The strut may be formed of similar materials and techniques.

The use of "first", "second", and the like in the following claims is for differentiation within the claim only and does not necessarily indicate relative or absolute importance or temporal order. Similarly, the identification in a claim of one element as "first" (or the like) does not preclude such "first" element from identifying an element that is referred to as "second" (or the like) in another claim or in the description.

One or more embodiments have been described. Nevertheless, it will be understood that various modifications may be made. For example, when applied to an existing baseline configuration, details of such baseline may influence details of particular implementations. Accordingly, other embodiments are within the scope of the following claims.

What is claimed is:

1. A gas turbine engine turbine section comprising:

an inner diameter structure;

a turbine exhaust case surrounding the inner diameter structure and having an outer ring and an inner ring in concentric and radially spaced relationship and a plurality of circumferentially spaced hollow struts interconnecting and supporting said inner ring and said outer ring to each other;

an outer casing surrounding said outer ring; and a plurality of tie rod assemblies interconnecting said inner diameter structure and said outer casing, each of said tie rod assemblies comprising:

a tie rod having:

an inner diameter end;

an outer diameter end; and an eyelet of an outer diameter spherical bearing formed at the outer diameter end;

at least a first clevis carrying a spherical ball between arms of said clevis, said spherical ball captured by the outer diameter spherical bearing eyelet, a shank of said clevis extending to an outer diameter (OD) end of said clevis; and a tensioning bolt mated to a threaded opening formed in said clevis OD end whereby tightening said bolt applies a tension to said rod relative to the outer casing, wherein:

a radial span between a center of the outer diameter spherical bearing and an inner diameter surface of the outer casing is at least 50% greater than a radial span between an outer diameter (OD) surface of the outer ring and the center of the spherical bearing.

2. The gas turbine engine turbine section of claim 1, the tie rod assemblies further comprising:

a plurality of struts, each strut respectively associated with an associated one of the tie rods, wherein:

the strut extends radially between the clevis OD end and the outer casing to transmit the tension from the associated rod to the outer casing.

3. The gas turbine engine turbine section of claim 2 wherein:

each strut has a hollow body extending between an outer diameter end an inner diameter end;

the inner diameter end has a web; and the associated tensioning bolt extends through the web.

4. The gas turbine engine turbine section of claim 3 wherein:

each strut outer diameter end has one or more laterally outwardly protruding mounting projections; and one or more fasteners secure the one or more mounting projections to the outer casing.

5. The gas turbine engine turbine section of claim 3 wherein:

each strut is formed of a wrought nickel-based alloy.

6. The gas turbine engine turbine section of claim 1 wherein:

a radial span between a center of the outer diameter spherical bearing and the clevis OD end is at least 50% greater than a radial span between an outer diameter (OD) surface of the outer ring and the center of the spherical bearing.

7. The gas turbine engine turbine section of claim 1 wherein:

said radial span between the center of the spherical bearing and the clevis OD end is at least 100% greater than the radial span between the outer diameter (OD) surface of the outer ring and the center of the spherical bearing.

8. The gas turbine engine turbine section of claim 1 wherein:

the clevis shank comprises a plurality of transverse apertures.

9. The gas turbine engine turbine section of claim 1 wherein:

a spring rate of each tie rod assembly between the tie rod and the outer casing is greater than a spring rate of the associated tie rod.

10. The gas turbine engine turbine section of claim 1 wherein for each tie rod assembly:

the tie rod has an inner diameter spherical bearing eyelet formed at the inner diameter end; and a second clevis is mounted to the inner diameter structure and carries a second spherical ball between arms of said second clevis, said second spherical ball captured by the inner diameter spherical bearing eyelet.

11. The gas turbine engine turbine section of claim 10 wherein for each tie rod assembly:

a radial span between a center of the outer diameter spherical bearing and an inner diameter surface of the outer casing is 30% to 200% of a radial span between the center of the inner diameter spherical bearing and the center of the outer diameter spherical bearing.

12. A gas turbine engine turbine section comprising:

an inner diameter structure;

a turbine exhaust case surrounding the inner diameter structure and having an outer ring and an inner ring in concentric and radially spaced relationship and a plurality of circumferentially spaced hollow struts interconnecting and supporting said inner ring and said outer ring to each other;

an outer casing surrounding said outer ring; and a plurality of tie rod assemblies interconnecting said inner diameter structure and said outer casing, each of said tie rod assemblies comprising:

a tie rod having:

an inner diameter end;

an outer diameter end;

an eyelet of an inner diameter spherical bearing formed at the inner diameter end; and an eyelet of an outer diameter spherical bearing formed at the outer diameter end;

an inner diameter clevis mounted to the inner diameter structure and carrying a first spherical ball between arms of said second clevis, said first spherical ball captured by the inner diameter spherical bearing eyelet;

an outer diameter clevis carrying a second spherical ball between arms of said outer diameter clevis, said second spherical ball captured by the outer diameter spherical bearing eyelet, a shank of said clevis extending to an outer diameter (OD) end of said clevis; and a tensioning bolt mated to a threaded opening formed in said clevis OD end whereby tightening said bolt applies a tension to said rod relative to the outer casing, wherein for each tie rod assembly:

a radial span between a center of the outer diameter spherical bearing and an inner diameter surface of the outer casing is 30% to 200% of a radial span between the center of the inner diameter spherical bearing and the center of the outer diameter spherical bearing.

13. The gas turbine engine turbine section of claim 12 wherein for each tie rod assembly:

the radial span between the center of the outer diameter spherical bearing and the inner diameter surface of the outer casing is 40% to 100% of the radial span between the center of the inner diameter spherical bearing and the center of the outer diameter spherical bearing.

14. The gas turbine engine turbine section of claim 12, the tie rod assemblies each further comprising:

a strut respectively associated with the associated tie rod, wherein:

the strut extends radially between the clevis OD end and the outer casing to transmit the tension from the associated rod to the outer casing.

15. The gas turbine engine turbine section of claim 14 wherein:

each strut has a hollow body extending between an outer diameter end and an inner diameter end;

the inner diameter end has a web; and the associated tensioning bolt extends through the web.

16. The gas turbine engine turbine section of claim 15 wherein:

each strut outer diameter end has one or more laterally outwardly protruding mounting projections; and one or more fasteners secure the one or more mounting projections to the outer casing.

17. The gas turbine engine turbine section of claim 15 wherein:

each strut is formed of a wrought nickel-based alloy.

18. A gas turbine engine turbine section comprising:

an inner diameter structure;

a turbine exhaust case surrounding the inner diameter structure and having an outer ring and an inner ring in concentric and radially spaced relationship and a plurality of circumferentially spaced hollow struts interconnecting and supporting said inner ring and said outer ring to each other;

an outer casing surrounding said outer ring;

a plurality of tie rod assemblies interconnecting said inner diameter structure and said outer casing, each of said tie rod assemblies comprising:

a tie rod having:

an inner diameter end;

an outer diameter end; and a spherical bearing eyelet formed at the outer diameter end;

at least a first clevis carrying a spherical ball between arms of said clevis, said spherical ball captured by the spherical bearing eyelet, said first clevis comprising:

a first shank having an outer diameter (OD) end; and a second shank having an outer diameter (OD) end; and a first bolt extending through an opening formed in said outer casing and mated to a threaded opening formed in said first shank OD end and a second bolt extending through an opening formed in said and mated to a threaded opening formed in said second shank OD end whereby tightening said first and second bolts applies a tension to said rod.

19. The gas turbine engine turbine section of claim 18 wherein:

each first clevis is formed of a wrought nickel-based alloy.

20. The gas turbine engine turbine section of claim 18 wherein:

the first and second shanks are at the same axial position along the engine.

* * * * *